US005213148A

United States Patent [19]

Masumoto et al.

[11] Patent Number: 5,213,148

[45] Date of Patent: May 25, 1993

[54] PRODUCTION PROCESS OF SOLIDIFIED AMORPHOUS ALLOY MATERIAL

[75] Inventors: Tsuyoshi Masumoto; Akihisa Inoue, both of Sendai; Hitoshi Yamaguchi, Okaya; Noriaki Matsumoto, Tokyo; Yutaka Sato, Osaka; Kazuhiko Kita, Sendai, all of Japan

[73] Assignees: Tsuyoshi Masumoto, Sendai; Teikoku Piston Ring Co., Ltd.; Honda Giken Kogyo Kabushiki Kaisha, both of Tokyo; Toyo Aluminum K.K., Osaka; Yoshida Kogyo, K.K., Tokyo, all of Japan

[21] Appl. No.: 664,056

[22] Filed: Mar. 1, 1991

[30] Foreign Application Priority Data

Mar. 2, 1990 [JP] Japan ..... 2-49491

[51] Int. Cl.[5] ..... B22D 7/10

[52] U.S. Cl. ..... 164/122; 164/485; 420/590

[58] Field of Search ..... 420/590, 416, 423, 550, 420/580; 164/122, 485

[56] References Cited

U.S. PATENT DOCUMENTS 4,621,676 11/1986 Steward ..... 164/485
4,715,428 12/1987 Johns et al. ..... 164/463

FOREIGN PATENT DOCUMENTS 0055827 7/1982 European Pat. Off. .
0095298 11/1983 European Pat. Off. .
1396701 6/1975 United Kingdom .
2174411 11/1986 United Kingdom .

*Primary Examiner*—John P. Sheehan
*Attorney, Agent, or Firm*—Flynn, Thiel, Boutell & Tanis

[57] ABSTRACT

A solidified amorphous alloy material is produced from a melt of its desired metal material. A melt feeding route is provided with a first-stage quenching zone. The melt is quenched to a predetermined temperature in the first-stage quenching zone. The thus-quenched melt is then introduced into a second-stage quenching and solidification zone, whereby the melt is cooled further and solidified into a solidified material having an amorphous phase.

18 Claims, 7 Drawing Sheets

PRODUCTION PROCESS OF SOLIDIFIED AMORPHOUS ALLOY MATERIAL

BACKGROUND OF THE INVENTION

1. Field of the Invention

This invention relates to a process for the production of a solidified material of an amorphous alloy, which features excellent strength, hardness and corrosion resistance.

2. Description of the Related Art

Conventional amorphous alloys have been obtained from metal materials having a desired composition only in the form of a ribbon, powder or thin film, by liquid quenching, which permits cooling at a rate higher than $10^{3}$° K./sec, or by vapor-phase deposition.

It is however desirous to obtain an amorphous alloy as a solidified material, because this will lead to broadening of its application range. With a view toward obtaining solidified materials of amorphous alloys, the present inventors hence attempted solidification of amorphous alloy powders, which had been obtained by gas atomization or the like, by methods such as pressure molding and the like. Those attempts however resulted in failure in easily obtaining solidified materials of desired amorphous alloys, as difficulties were encountered in controlling their thermal histories upon solidification to avoid their crystallization, their production processes became more complex and their production costs increased.

SUMMARY OF THE INVENTION

An object of the present invention is therefore to obtain, with relative ease and at a lower cost, solidified materials having high strength, high hardness, high corrosion resistance and the like, which are characteristic properties of amorphous alloys, and also to obtain solidified materials which have an amorphous phase and are of various different shapes.

In one aspect of the present invention, there is thus provided a process for the production of a solidified amorphous alloy material from a metal melt, characterized in that a melt of a desired metal material is quenched to a predetermined temperature in a first-stage quenching zone provided on a melt feeding route and then introduced into a second-stage quenching and solidification zone, whereby the melt is cooled further and solidified into a solidified material having an amorphous phase.

According to the present invention, a melt of a metal material having a specific composition is cooled in two stages under the particular conditions. This makes it possible to obtain with relative ease a solidified material having high strength, high hardness, high corrosion resistance, which are characteristic properties of amorphous alloys, and also to obtain solidified amorphous alloy materials of various different shapes. The present invention can therefore broaden the application range of amorphous alloy materials.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE PREFERRED EMBODIMENTS

Figure 1:
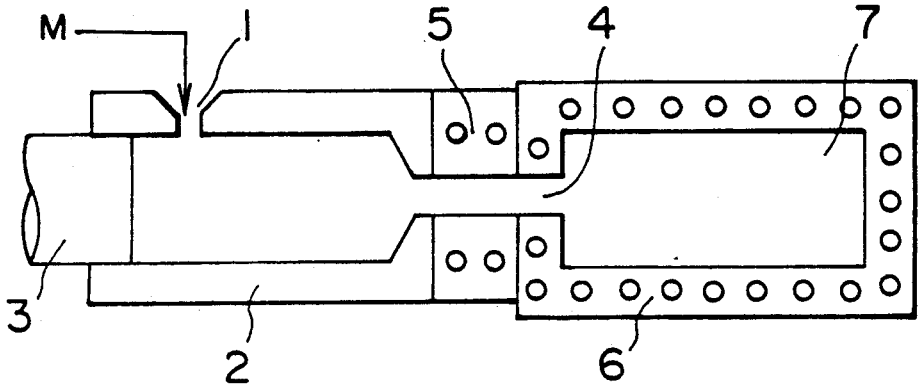
FIG. 1 is a conceptual view of an apparatus suitable for use in the practice of the present invention.

Illustrative of the desired metal material to which the present invention can be applied may include the alloys disclosed in copending Japanese Patent Application Nos. 103812/1988, 171298/1989, 177974/1990, and 297494/1990. Namely, exemplary metal materials include $Al_xFe_yLa_z$, $Al_xCu_yMm_z$ (Mm: misch metal), $Al_xZr_yFe_z$, $Al_xZr_yCo_z$, $Al_xNi_yY_zCo_w$, $Al_xNi_yY_zFe_w$, $Al_xNi_yCe_zCo_w$, and so on. Preferred as the desired metal material are alloy materials having glass transition temperatures, the ratios (Tg/Tm) in absolute temperature of their glass transition temperatures (Tg) to their melting points (Tm) being at least 0.55. Such alloy materials have an excellent ability to form an amorphous phase, so that solidified amorphous alloy materials can be produced with relative ease.

Incidentally, Tg (glass transition temperature) referred to above is the temperature at which a leading edge of a DSC (differential scanning calorimetry) curve and an extrapolation of a base line cross each other in an area where an endothermic reaction takes place, while Tm is the melting point of the metal material. The ratio in absolute temperature (Tg/Tm) of the Tg to the Tm is a factor which can indicate how easily the alloy melt can be converted to an amorphous solid.

By conducting two-stage cooling treatment in the first-stage quenching zone and the second-stage quenching and solidification zone as described above, it is possible to obtain a solidified alloy material containing an amorphous phase and having a relatively large thickness. To ensure the provision of a solidified amorphous alloy material having an amorphous phase and a greater thickness, it is necessary to remove heat from the metal melt as much as feasible in the first-stage quenching zone. In the first-stage quenching zone, the melt can be quenched at a cooling rate of at least $10^{2}$° K./sec, preferably to a temperature in a range of the melting point (Tm, K) of the alloy material ±100° K., more preferably to a temperature in a range of from the melting point (Tm, K) of the alloy material to Tm−100 (K) (supercooled liquid range). The metal material is in a supercooled liquid state in this range so that the metal material is in a liquid state although its temperature is below the melting point. Like a liquid, the metal material can still be moved in the first-stage quenching zone and injected into the second-stage quenching and solidification zone.

To quench the melt of the metal material to the predetermined temperature, the first-stage quenching zone provided along the melt feeding route may have a particular structural feature such that the passageway is constricted there, in other words, is formed like an orifice or nozzle. As an alternative or additional means, quenching conditions such as the type of a cooling medium can be selected and applied suitably. After the melt has been quenched (controlled) to the predetermined temperature in the first-stage quenching zone, the thus-quenched melt is finally subjected to second-stage quenching and solidification in the second-stage quenching and solidification zone. By applying the two-stage cooling treatment, a large majority of the heat quantity of the melt can be removed in the first stage, namely, in the first-stage quenching zone so that heat quantity to be removed for solidification in the second stage, namely, in the second-stage quenching and solidification zone, can be reduced. This makes it possible to obtain, with relative ease, a solidified material having a greater thickness than the thickness (5-500 μm) of a thin ribbon available by conventional liquid quenching or the like, for example, a solidified material containing at least 50% by volume of an amorphous phase.

Describing this further, it is generally required to effect cooling of a material at least at a rate specific to the material in order to obtain an amorphous phase. Further, to obtain a solidified material having a thick wall, the cooling rate becomes lower in a final solidification stage so that no amorphous phase can be obtained. In the present invention, to remove a heat quantity as large as possible in the first stage, namely, in the first-stage quenching zone in view of the foregoing requirement and problem, the release of heat from the melt is accelerated, for example, by causing the melt to pass through the constricted passageway as described above, whereby the melt is quenched to the predetermined temperature. The thus-quenched melt is then introduced into the second-stage quenching and solidification zone which is greater than the first-stage quenching zone and is cooled there, so that a solidified material containing an amorphous phase can be obtained. By avoiding thermal influence from a melt feed portion of a high temperature, the process of the present invention has made it possible to make the cooling rate higher than that available in the case of solidification by single-stage cooling and hence to obtain a solidified alloy material having a relatively large thickness and containing an amorphous phase. It is therefore possible to easily obtain a solidified alloy material containing an amorphous phase by using a water-cooled mold, water-cooled rolls or the like, the cooling ability of which is limited.

Upon conducting the final cooling treatment, pressurization of the metal melt of the predetermined temperature in the second-stage quenching and solidification zone can increase the conductivity of heat from the surface of a solidified part because the contact between the cooling means and the melt to be cooled can be enhanced. This is understood from certain techniques practiced in the field of metallurgy. For example, it is possible to achieve a higher thermal conductivity in die casting by blowing a melt of a metal material, said melt having been pressurized in a melt feeding route and having a predetermined temperature, against the inner wall of a mold. It is also possible to bring about a higher thermal conductivity in melt rolling by pressing through paired rolls a metal material which is in a supercooled liquid state. Upon introduction of the metal melt into the second-stage quenching and solidification zone, it is preferred to introduce the melt after pressurizing it to 0.1 kgf/cm$^2$ or higher. This pressurized introduction is however not absolutely necessary where the metal melt is introduced into the second-stage quenching and solidification zone by making use of gravity.

As a pressurizing means usable upon introduction of the melt into the second-stage quenching and solidification zone, it is possible to use, for example, a melt pump or a plunger or indirect pressurization in which a closed melt compartment is pressurized by a gas. It is also possible to pressurize the melt in the second-stage quenching and solidification zone by rotating the second-stage quenching and solidification zone at a high speed. In the latter case, application of centrifugal force at least 10 times (10 G) the gravitational acceleration to the melt is effective in causing the melt to hit the wall so that the contact between the cooling means and the melt to be cooled can be improved to increase the thermal conductivity.

The above solidification zone can be, for example, a casting portion of a cooled mold in die casting, a forging portion of a cooled mold in melt-forging, or a zone defined between the surfaces of a pair of water-cooled rolls in melt rolling.

According to the process of the present invention, it is possible to form an amorphous phase only in a desired portion of a solidified material, to say nothing of the formation of an amorphous phase throughout the surfaces and interior of the solidified material, and also to enlarge the thickness of an amorphous phase in a desired portion. It is therefore feasible to selectively produce various solidified materials depending on the end use, including, for example, those having surfaces composed primarily of an amorphous phase and an interior formed predominantly of a fine crystalline phase, those having upper and lower surfaces composed principally of an amorphous phase and side surfaces composed primarily of a fine crystalline phase, those having upper and lower surfaces formed primarily of an amorphous phase of a large thickness, side surfaces composed predominantly of an amorphous phase of a small thickness and an interior composed of a fine crystalline phase.

The above-described production can be carried out by changing the thermal conductivity of the melt and that of the second-stage quenching and solidification zone at certain locations. The above-described solidified materials can be obtained, for example, by changing the cooling ability of a cooling medium at such certain locations, changing the thickness of the second-stage quenching and solidification zone at desired locations or forming desired portions of the second-stage quenching and solidification zone with a material different from the material of the remaining portions of the second-stage quenching and solidification zone.

According to the present invention, a melt of a metal material of a desired composition is once cooled to a predetermined temperature in the first-stage quenching zone along the melt feeding route to control the temperature of the melt, followed by the introduction in a suitable quantity into the second-stage quenching and solidification zone, preferably under pressure, whereby the melt can be solidified, even at substantially the conventional cooling rate, while retaining an amorphous state, and solidified, materials of various shapes can hence be formed.

The present invention will hereinafter be described specifically on the basis of the following examples.

EXAMPLE 1

Figure 2A:
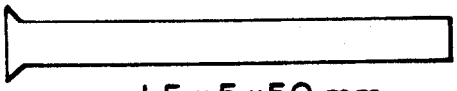
FIGS. 2(*a*) and 2(*b*) are schematic illustrations of products obtained by the apparatus of FIG. 1.
Figure 2B:
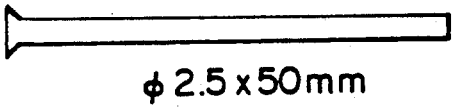

An alloy melt having the alloy composition of $La_{70}Ni_{10}Al_{20}$ (by atomic percentage) was prepared in a high-frequency melting furnace. Through a sprue 1 of the casting apparatus shown in FIG. 1, the alloy melt designated at M was poured into a melt feeding route 2. Through the melt feeding route 2, the melt M was introduced under a constant pressure toward a gate 4 by a plunger 3. In the course of the introduction, the melt M was cooled to a predetermined temperature (670° K.) in a first-stage quenching zone 5 which had been provided with constricted passageway in the melt feeding route 2. The thus-cooled melt M was allowed to flow out at a rate of 16 g/sec through the gate 4 and was then introduced under pressure into a second-stage quenching and solidification zone 7 defined inside a water-cooled mold 6. The melt M was solidified at a cooling rate of approximately $10^{2°}$–$10^{3°}$ K./sec in the second-stage quenching and solidification zone 7 inside the mold 6, so that solidified material was formed. The solidified material obtained in the manner described above can take a desired shape by changing the mold, for example, like a plate-like member of 1.5 mm thick, 5 mm wide and 50 mm long or a rod-like member of 2.5 mm across and 50 mm long as shown in FIGS. 2(*a*) and 2(*b*), respectively.

Those members were subjected to X-ray diffraction to investigate their structures. For the sake of comparison, an amorphous thin ribbon of the same alloy composition was produced by a melt spinning technique. The amorphous thin ribbon was also subjected to X-ray diffraction. The results are shown in FIG. 3.

Figure 3:
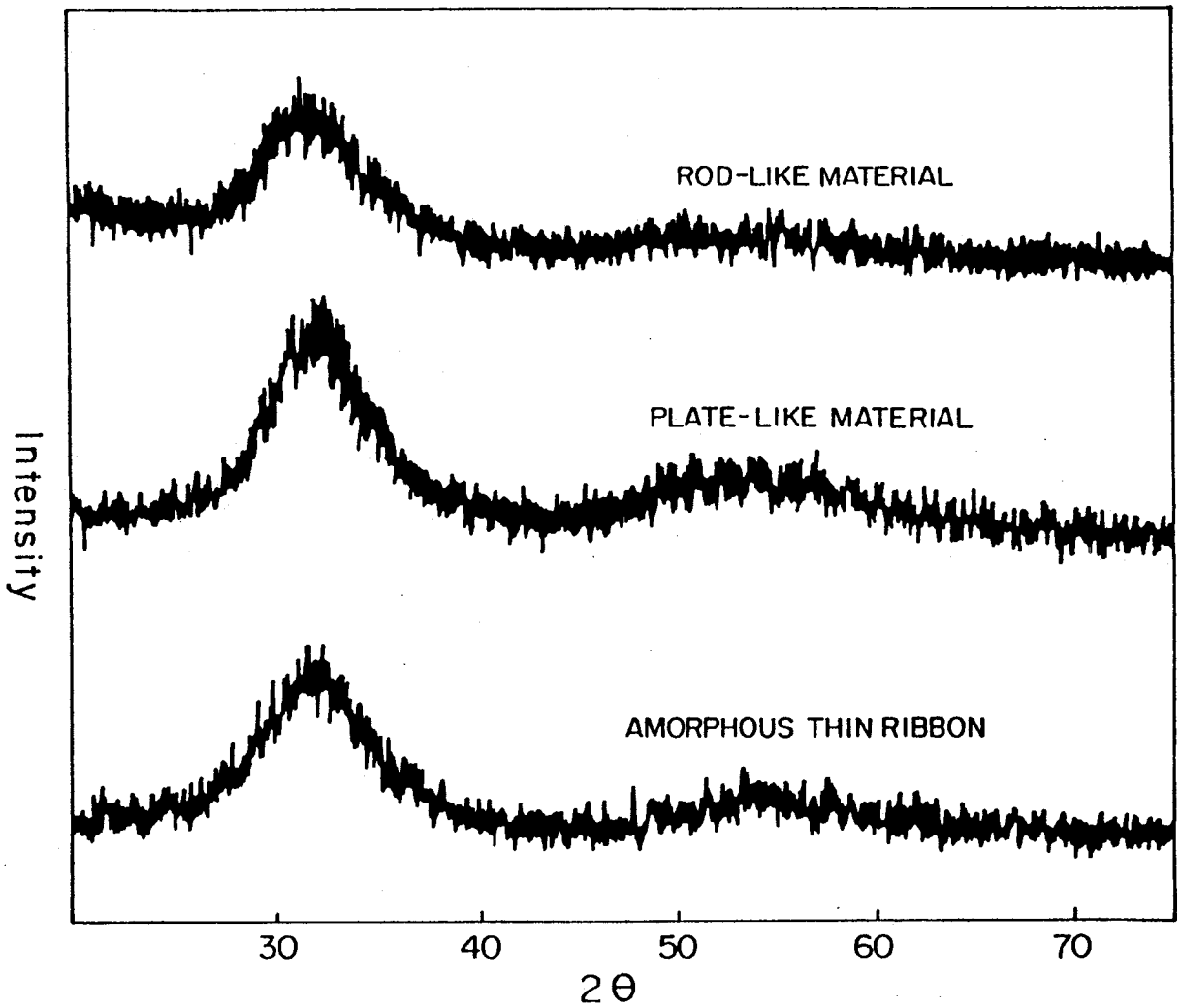
FIG. 3 is a diagram showing X-ray diffraction patterns of products obtained in examples of the present invention and that of a product obtained in a comparative example.
Figure 4:
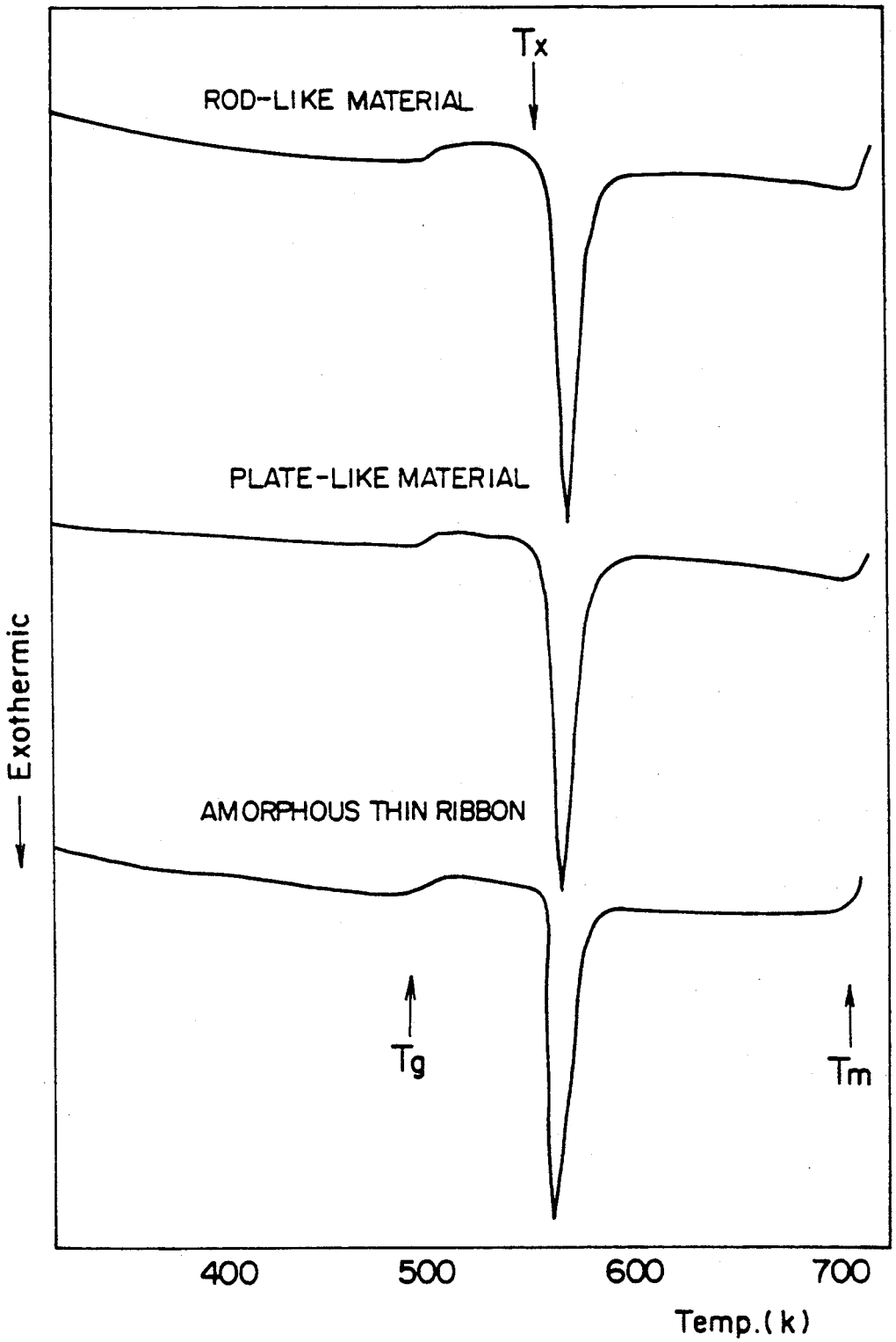
FIG. 4 diagrammatically illustrates calorimetric curves of the products obtained in the examples of the present invention and those of the product obtained in the comparative example.

As is illustrated in FIG. 3, a halo pattern inherent to amorphous metals is observed in the case of each of the solidified, plate-like and rod-like materials according to the present invention. The solidified, plate-like and rod-like materials also gave substantially the same diffraction results as the amorphous thin ribbon of the comparative example. It is understood from these results that each solidified materials according to the present invention is composed of an amorphous phase. In addition, an investigation was also conducted on the structures of the thus-obtained solidified materials on the basis of calorimetric curves ascertained by a thermal analysis (differential scanning calorimetry). Calorimetric curves of the amorphous thin ribbon of the comparative example was also measured. FIG. 4 illustrates the results of the measurements. In the case of each of the solidified, plate-like and rod-like materials according to the present invention and the amorphous thin ribbon of the comparative example, similar exothermic peaks and endothermic peaks were exhibited and similar calorimetric curves were observed. It is therefore understood that the solidified materials according to the present invention were composed of an amorphous phase.

EXAMPLE 2

An alloy melt M having the alloy composition of $La_{70}Ni_{10}Al_{20}$ was prepared in a high-frequency melting furnace. Through a sprue 8 of the casting apparatus shown in FIG. 5, the alloy melt M was poured into a melt feeding route 9. Through the melt feeding route 9, the melt M was introduced under a constant pressure toward a gate 10 by a pressure pump 11. The melt M was cooled to a predetermined temperature (670° K.) in a first-stage quenching zone (temperature controlling portion) 12 provided in the melt feeding route 9. The thus-cooled melt M was introduced under pressure at a flow rate of 16 g/sec from the gate 10 into a solidification zone 14 defined between a pair of water-cooled rolls 13,13. The melt M was then solidified at a cooling rate of approximately $10^{2°}$ K./sec so that a solidified plate-like material was obtained. The solidified material thus obtained was a continuous plate of 1.2 mm thick and 6.3 mm wide. The plate was subjected to X-ray diffraction as in Example 1. As a result, it was found that the continuous plate was substantially the same as the solidified plate-like material of Example 1 and was also formed of an amorphous phase. In addition, calorimetric curves were also measured by DSC as in Example 1. The results were substantially the same as those obtained in Example 1. From the results, it is also understood that the solidified plate-like material obtained in this example was formed of an amorphous phase.

Figure 5:
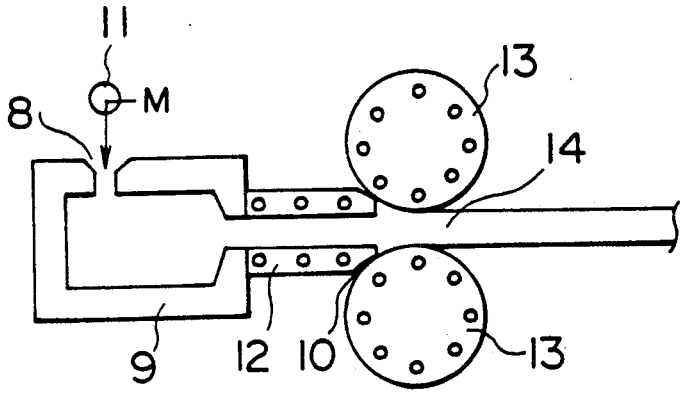
FIGS. 5 through 10 are conceptual views of other apparatus also suitable for use in the practice of the present invention.

A continuous plate having greater width and thickness than that obtained in the above example can be produced by arranging a plurality of casting apparatus of the same type as that of FIG. 5 side by side at an appropriate spacing and using water-cooled rolls having a size corresponding to the plurality of casting apparatus.

In the case of plate-like materials of a predetermined limited length, their production can be conducted using a plunger as in Example 1. Production of plate-like materials of a continuous length can be performed by arranging a screw-like pressure device in the melt feeding route. Pressurization of the melt can also be effected by disposing the apparatus upright and pressurizing a melt under gravity. As a further alternative, the production of such a plate-like material can also be achieved by drawing it with a pair of rolls without pressurization of the melt in the melt feeding route.

Results similar to those of the above example were also obtained when metal materials having the alloy compositions of $Zr_{55}Cu_{25}Al_{20}$ and $Mg_{50}Ni_{30}La_{20}$ were employed.

EXAMPLE 3

Figure 6:
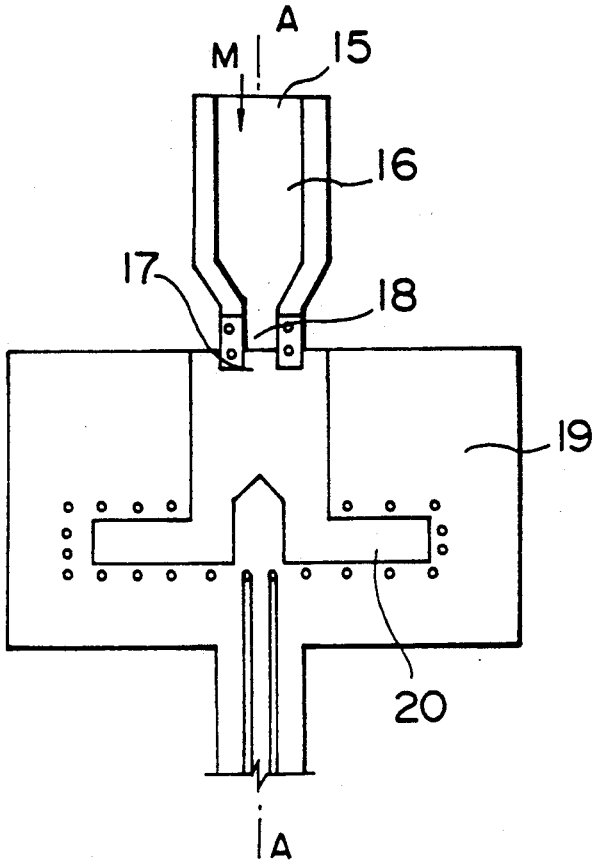

A melt M having the alloy composition of $Al_{8.5}Ni_5Y_8Co_2$ was prepared in a high-frequency melting furnace. The melt M was poured into a melt feeding route 16 through a sprue 15 of the casting apparatus illustrated in FIG. 6. The melt M was pressurized by Ar gas and introduced at 0.5 kgf/cm$^2$ through the melt feeding route 16 toward a gate 17. The melt M was cooled to predetermined temperature (890° K.) in a first-stage quenching zone (temperature controlling portion) 18 provided in the melt feeding route 16. The thus-cooled melt M was poured under pressure into a second-stage quenching and solidification zone 20 located inside a copper mold 19 whose casting portion is located 50 mm apart from the gate 17 of 0.5 mm across. The melt M was water-cooled and solidified at a cooling rate of about $10^{2°}$–$10^{3°}$ K./sec in a second quenching zone 20 of the mold 19 while the mold 19 was rotated at the revolution number of 1500 rpm around line A—A in FIG. 6, whereby the melt was converted to a solidified material. The solidified material thus obtained was a disk-like member having a diameter of 25 mm, a thickness of 2 mm thick and a central hole diameter of 5 mm. Similarly to Example 1, the disk-like member was subjected to X-ray diffraction and its calorimetric curve was measured by DSC. The respective results were similar to those obtained in Example 1. Therefore, it is also understood from those results that the disk-like member obtained in this example was composed of an amorphous phase. It was also found from the DSC measurement that the crystallization temperature (Tx) and glass transition temperature (Tg) of the above member were 565° K. and 530° K., respectively. The hardness (Hv) of the above member was also measured. As a result, the hardness was found to be 380 (DPN). It is therefore understood that the solidified material thus obtained has a high hardness.

Figure 7:
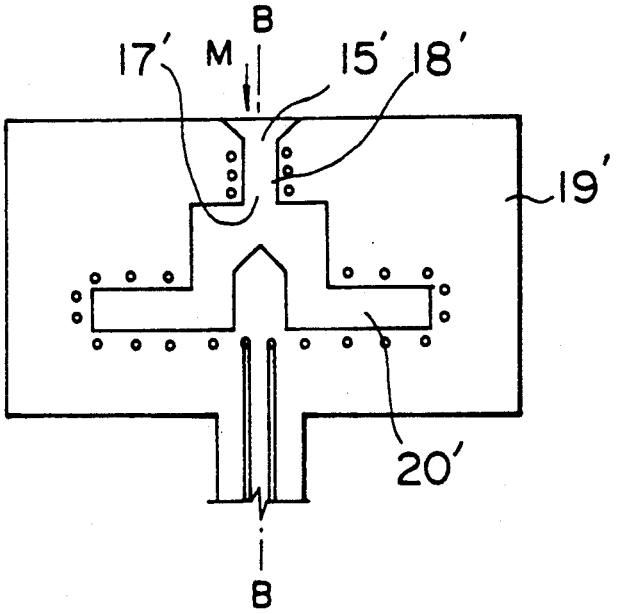

The above production process is useful for producing small parts such as disks and gears. FIG. 7 illustrates a modification of the above process. A melt feeding route, a first-stage quenching zone 18', a gate 17', etc. are provided commonly in a mold 19' which is provided for rotation about line B—B in the drawing. A melt M is poured through an orifice-like sprue 15' of the mold 19', so that a solidified, disk-like material having an amorphous phase, said material being similar to the disk-like material obtained above, was obtained in a similar manner.

EXAMPLE 4

Figure 8:
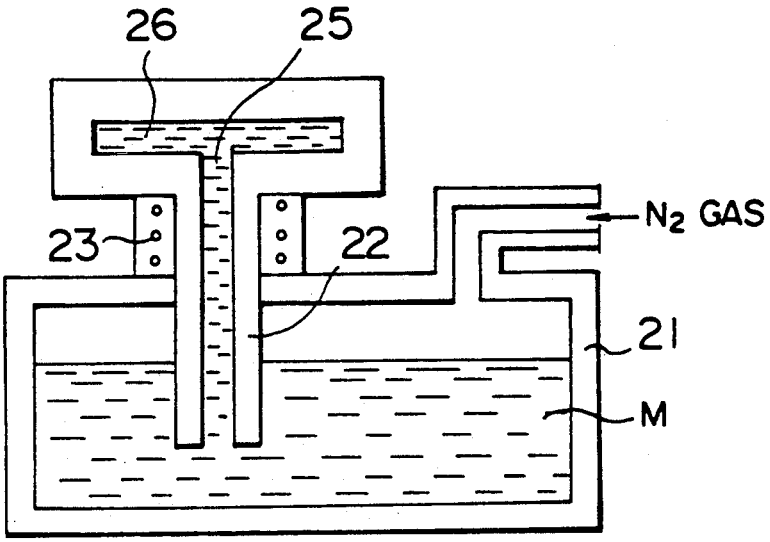

A melt M having the alloy composition of $La_{70}Ni_{10}Al_{20}$ was prepared in a high-frequency melting furnace. The melt M was stored in a melt compartment 21 of the casting apparatus shown in FIG. 8. The melt compartment 21 was pressurized to 0.5 kgf/cm$^2$ by $N_2$ gas, so that the melt M was introduced into a melt feeding path 22. The melt M flowed through the first-stage quenching zone 23 and was then introduced under pressure into a water-cooled, second-stage quenching and solidification zone 26. The melt M was cooled to a predetermined temperature (670° K.) in the first-stage quenching zone 23. Through a gate 25, whose diameter was 1 mm, the thus-cooled melt M was introduced under pressure into a casting portion of the second-stage quenching and solidification zone 26, which casting portion had been depressurized to $10^{-2}$ Torr by a vacuum pump (not shown). The melt M was solidified at a cooling rate of about $10^{2°}$–$10^{3°}$ K./sec. The solidified material thus obtained was a disk-like member of 20 mm across and 2 mm thick. Similarly to Example 1, the disk-like member was subjected to X-ray diffraction and its calorimetric curve was also measured by DSC. The respective results were similar to those obtained in Example 1. Therefore, it is also understood from those results that the disk-like member obtained in this example was composed of an amorphous phase.

EXAMPLE 5

A molten alloy having the alloy composition of $Mg_{50}Ni_{30}La_{20}$ was prepared in a high-frequency melting furnace. The molten alloy was processed in a similar manner to Example 1 in the casting apparatus depicted in FIG. 1, whereby a solidified, rod-like material of 2.5 mm across and 50 mm long was obtained. The solidified material was cut and then subjected to X-ray diffraction. As a result, it was found that the solidified material was composed of an amorphous phase to a depth of 0.5 mm from the surface thereof and was formed of a fine crystalline phase beyond that depth. Further, the solidified material thus obtained was cut, and one of the cut surfaces was ground and then immersed for 5 minutes in a 1N aqueous solution of hydrochloric acid. As a result, no corrosion was observed in the surface layer of the solidified material although the inside was corroded. This indicates that the process of the present invention is effective for the surface modification of a solidified material.

Owing to the formation of the amorphous phase in the surface layer only and the fine crystalline phase inside the surface layer in the above example, the resultant solidified material was much greater than a solidified material which would have been obtained if both the surface layer and the inside had been formed of an amorphous phase.

In the present invention, such surface modification can provide solidified materials having a surface layer having better adhesion as compared with those subjected to surface modification by a conventional method such as vacuum deposition.

Figure 9A:
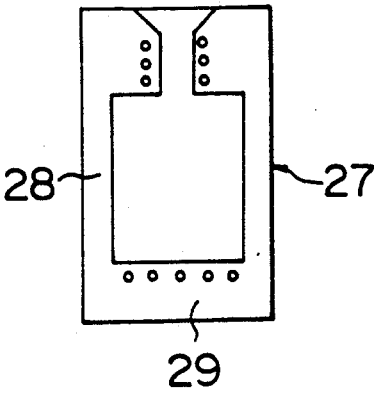
Figure 9B:
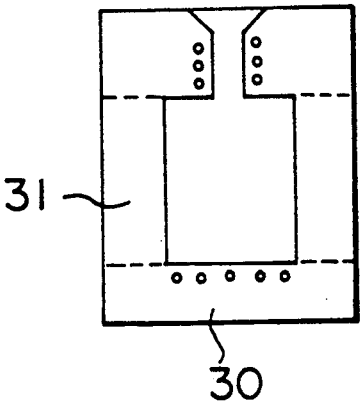

It is also possible to form an amorphous phase in a bottom layer only of a solidified material or to obtain a solidified material having amorphous phases of different thicknesses in a bottom surface thereof and in side surfaces thereof, respectively by, as shown in FIG. 9(*a*), making the thickness of side walls 28 of mold 27 thinner and the thickness of a bottom wall 29 thicker. Similar solidified materials can also be obtained by, as depicted in FIG. 9(*b*), using a mold whose bottom wall 30 and side walls 31 are made of different materials. By making the side walls 31 of the mold with steel and the bottom wall 30 thereof with copper for example, it is possible to obtain a solidified material in which a fine crystalline phase or a thin amorphous phase is formed on the side of each side wall 31 having a lower thermal conductivity while a thick amorphous layer is formed on the side of the bottom wall 30.

In the manner described above, solidified materials suitable for various applications can be obtained at a relatively low cost.

EXAMPLE 6

Figure 10:
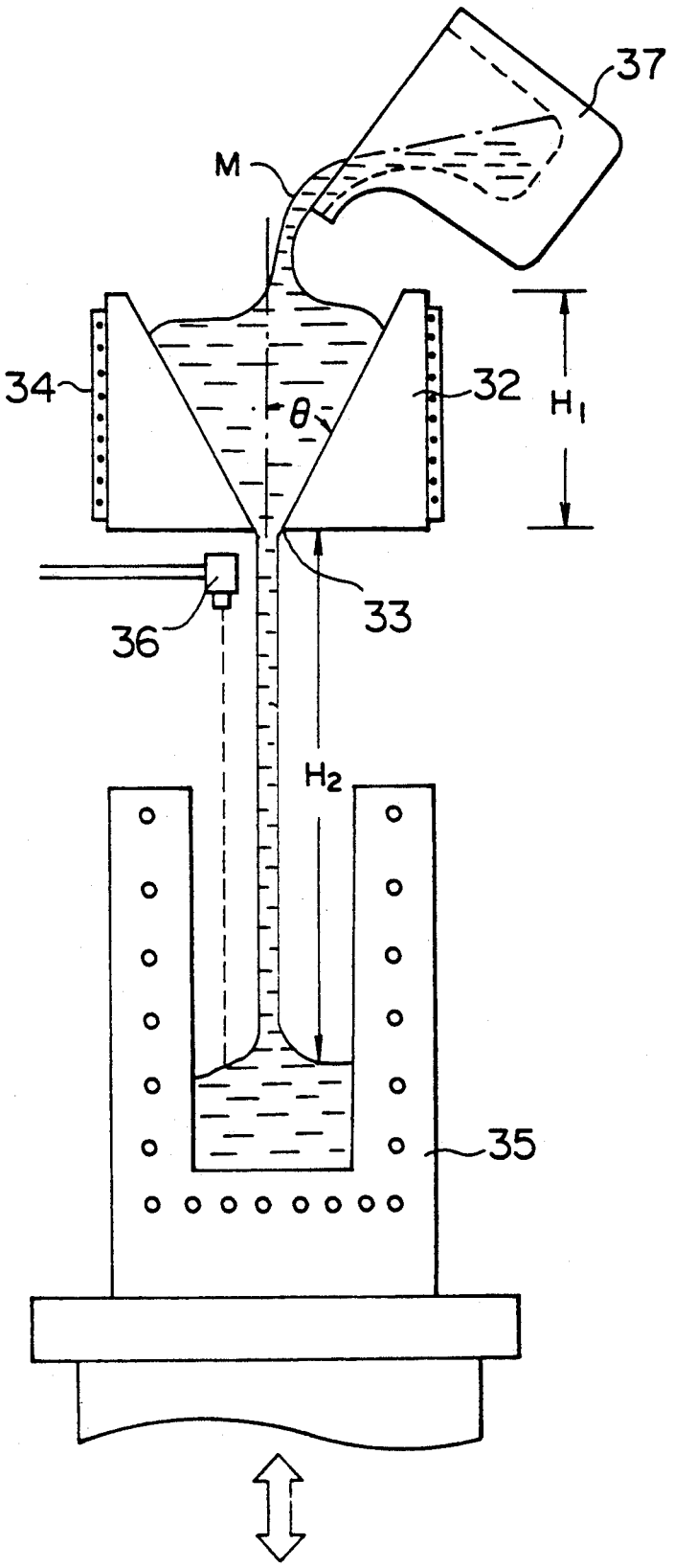

A molten alloy having the alloy composition of $La_{70}Ni_{10}Al_{20}$ was prepared in a high-frequency melting furnace. As illustrated in FIG. 10, the molten metal designated at M was poured at a temperature about 100° C. higher than its melting point into a tundish 32. The tundish 32 is in the form of a metal-made funnel. The horizontal cross-sectional area of a reservoir for the melt M gradually decreases toward a melt outlet 33. A heater 34 is provided around the periphery of the tundish 32, whereby the tundish 32 located inside the heater 34 is heated at a temperature 50° C. lower than the melting point. As the horizontal cross-sectional area of the melt M in the tundish 32 continuously decreases in the downward direction, the distance between the heater 34 and the melt M becomes greater as the melt M flows downwardly toward the outlet 33. The melt M is therefore cooled at a constant rate as the melt M moves toward the outlet 33. In addition, the height $H_1$ and angle $\theta$ of the tundish 32 are determined suitably so that, at the outlet 33, the melt M can be kept unaffected by any waving of the melt M caused by subsequent pouring of the melt M from a crucible 37. In this example, $H_1$ and $\theta$ were set at 50 mm and 25°, respectively. The diameter of the melt outlet 33 was set at 2 mm. At the melt outlet 33, the melt M can have a temperature substantially right above the melting point. The melt M discharged from the melt outlet 33 is brought into a supercooled liquid state by radiation cooling while it drops into a mold 35 (first-stage quenching zone). In a vacuum ($2\times10^{-4}$ Torr), good amorphous members were obtained when the distance $H_2$ from the melt outlet 33 to a melt solidification level in the mold 35 was 50–150 mm. To obtain still longer members, elongated amorphous member of good quality can be stably obtained by measuring the distance $H_2$, for example, with an optical means 36 and then lowering the mold 35 until the distance $H_2$ reaches a predetermined value.

Unless such a tundish is used as in the present example, the temperature of the melt M at the melt outlet 33 becomes higher and, as a matter of fact, it is difficult to control the temperature of the melt M. A higher melt temperature requires a longer distance ($H_2$). A longer distance $H_2$, however, involves the potential problem that non-uniform nucleation may be produced while the melt is passing through the distance $H_2$. It is therefore not preferred to increase the distance $H_2$. Where the tundish is made of a refractory material and is employed solely to constrict the flow of the melt, it is necessary to set $H_2$ at 250 mm. Since the tolerance of $H_2$ is as small as about ±10 mm, there is the possibility of non-uniform nucleation. In addition, the difficulty in temperature control leads to poor reproducibility, resulting in cast materials whose properties deviated significantly from one to another.

What is claimed is:

1. A process for the production of a solidified amorphous alloy material from a metal melt comprising the steps of:

quenching a melt of a desired metal material in a first-stage quenching zone provided in a melt feeding route so that the melt is quenched to a temperature range of from ±100° K. of the melting point (Tm) of the metal material; and introducing the melt into a second-stage quenching and solidification zone where the melt is cooled further and solidified into a solid material having an amorphous phase.

2. The process of claim 1, wherein the desired metal material is an alloy material, the ratio (Tg/Tm) in absolute temperature of its glass transition temperature (Tg) to its melting point (Tm) being at least 0.55.

3. The process of claim 1, wherein in the first-stage quenching zone, the melt is quenched at a cooling rate of at least $10^{2°}$ K./sec.

4. The process of claim 1, wherein in the second-stage quenching zone, the melt is cooled at a cooling range of at least $10^{2°}$ K./sec to a temperature not higher than the glass transition temperature (Tg) of the metal material.

5. The process of claim 1, wherein the first quenching zone is located at one end of the melt feeding route, the first quenching zone being jointed to the end of the second-stage quenching and solidification zone and is in the form of a constricted orifice or nozzle.

6. The process of claim 1, wherein the temperature of the melt is controlled in a reservoir for the melt provided at a location upstream of first-stage quenching zone.

7. The process of claim 6, wherein the cross-sectional area of the reservoir gradually decreases in the direction of a flow of the melt toward a melt outlet.

8. The process of claim 7, wherein the temperature of the melt at the melt outlet is controlled not lower than the melting point (Tm) of the metal material but not higher than the melting point of the metal material plus 100° K. (Tm+100° K.).

9. The process of claim 1, wherein the melt is introduced into the second-stage quenching and solidification zone under a pressure of at least 0.1 kgf/cm$^2$.

10. The process of claim 9, wherein the melt is pressurized by a melt pump, a melt plunger, or indirect pressurization in which a closed melt compartment is pressurized with a gas.

11. The process of claim 1, wherein the melt is cooled in the second-stage quenching and solidification zone while pressurizing the melt under a centrifugal force of at least 10 times (10G) the gravitational acceleration by rotating the second-stage quenching and solidification zone at a high speed.

12. The process of claim 1, wherein the melt is quenched and solidified in the second-stage quenching and solidification zone, the thermal conductivity of a desired portion thereof being higher than that of any other portion thereof.

13. The process of claim 1, wherein the melt is quenched and solidified in the second-stage quenching and solidification zone, the thickness of a desired portion thereof being greater than that of any other portion thereof.

14. The process of claim 1, wherein the melt is quenched and solidified in the second-stage quenching and solidification zone, a desired portion thereof being made of a material having a higher thermal conductivity than that of a material used of any other portion thereof.

15. The process of claim 1, wherein the melt is cooled at a cooling rate of at least $10^{2°}$ K./sec at a location proximal to an inner wall of the second-stage quenching and solidification zone.

16. A process for the production of a solidified amorphous alloy material from a metal melt comprising the steps of:

melting a desired metal material;

introducing the resultant melt into a melt feeding route;

quenching the melt in a first-stage quenching zone provided in the melt feeding route so that the melt is quenched to a temperature range of from ±100° K. of the melting point (Tm) of the metal material; and introducing the melt into a second-stage quenching and solidification zone where the melt is cooled further and solidified into a solid material having an amorphous phase.

17. The process of claim 16, wherein in the first-stage quenching zone, the melt is quenched at a cooling rate of at least $10^{2°}$ K./sec.

18. A process for the production of a solidified amorphous alloy material from a metal melt consisting essentially of the steps of:

quenching a melt of a desired metal material in a first-stage quenching zone provided in a melt feeding route so that the melt is quenched to a temperature range of from ±100° K. of the melting point (Tm) of the metal material; and introducing the melt into a second-stage quenching and solidification zone where the melt is cooled further and solidified into a solid material having an amorphous phase.

* * * * *